US011492183B2

(12) United States Patent
Lee et al.

(10) Patent No.: US 11,492,183 B2
(45) Date of Patent: Nov. 8, 2022

(54) CHEMICAL CONTAINER

(71) Applicant: LOWTEM CO., LTD., Gunpo-Si (KR)

(72) Inventors: Sang Il Lee, Anyang-Si (KR); Gwang Ho Mun, Anyang-Si (KR)

(73) Assignee: LOWTEM CO., LTD., Gunpo-si (KR)

( * ) Notice: Subject to any disclaimer, the term of this patent is extended or adjusted under 35 U.S.C. 154(b) by 20 days.

(21) Appl. No.: 17/268,251

(22) PCT Filed: Jun. 20, 2019

(86) PCT No.: PCT/KR2019/007442
§ 371 (c)(1),
(2) Date: Feb. 12, 2021

(87) PCT Pub. No.: WO2020/040415
PCT Pub. Date: Feb. 27, 2020

(65) Prior Publication Data

US 2021/0171251 A1 Jun. 10, 2021

(30) Foreign Application Priority Data

Aug. 22, 2018 (KR) ..... KR10-2018-0097836

(51) Int. Cl.
*B65D 51/16* (2006.01)
*B65D 81/26* (2006.01)
*B65D 85/00* (2006.01)

(52) U.S. Cl.
CPC ..... *B65D 51/1611* (2013.01); *B65D 51/1616* (2013.01); *B65D 81/26* (2013.01);
(Continued)

(58) Field of Classification Search
CPC ... B63B 22/24; B65D 90/511; B65D 51/1611; B65D 51/1616; B65D 81/26;
(Continued)

(56) References Cited

U.S. PATENT DOCUMENTS 3,593,533 A * 7/1971 Washington ..... E02F 7/005 37/313
3,618,150 A * 11/1971 Anselmi ..... B63B 22/08 441/20

(Continued)

FOREIGN PATENT DOCUMENTS

JP 2013-522130 A 6/2013
KR 20-1998-0067775 U 12/1998
KR 20-0271482 Y1 4/2002

*Primary Examiner* — Kareen K Thomas
(74) *Attorney, Agent, or Firm* — Rabin & Berdo, P.C.

(57) ABSTRACT

Disclosed is a chemical container capable of discharging gas generated from a chemical by stably securing a discharge passage of the gas even when the posture or tilt of the chemical container is variously changed, i.e. when the chemical container is turned over or falls sideways, whereby it is possible to prevent an excessive increase in internal pressure of the chemical container due to generation of the gas. The chemical container includes a container body having a storage compartment configured to store a chemical, an exhaust port disposed at one side of the container body, the exhaust port being configured to connect the storage compartment and the outside of the container body to each other in such a manner that fluid movement therebetween is possible, an exhaust tube disposed in the storage compartment so as to be connected to the exhaust port in such a manner that fluid movement therebetween is possible, and an exhaust buoyancy unit. The exhaust buoyancy unit has a buoyancy body disposed in the storage compartment in the state of being connected to the exhaust tube so as to float on the chemical stored in the storage compartment, an exhaust channel provided inside the buoyancy body, the exhaust channel being configured to connect the storage compartment and the exhaust tube to each other in such a manner that fluid movement therebetween is possible, and a filter membrane coupled to the buoyancy body, the filter membrane being configured to transmit gas through the exhaust channel and to block the chemical, thereby preventing the chemical from passing therethrough.

4 Claims, 10 Drawing Sheets

(52) U.S. Cl.
CPC ..... *B65D 85/70* (2013.01); *B65D 2213/00* (2013.01); *Y10T 137/3084* (2015.04); *Y10T 137/3087* (2015.04)

(58) Field of Classification Search
CPC .... B65D 85/70; B65D 2213/00; B65D 85/84; B65D 47/06; Y10T 137/3084; Y10T 137/3087
See application file for complete search history.

(56) References Cited

U.S. PATENT DOCUMENTS 3,672,533 A * 6/1972 McKean ..... B65D 51/1616 220/745
5,413,137 A * 5/1995 Gimby ..... F16K 24/044 137/200
5,653,943 A 8/1997 Arnold
5,803,778 A * 9/1998 Hardy ..... B63B 29/16 441/136
8,640,930 B2 2/2014 Nunez et al.
8,943,992 B1 * 2/2015 Petersen ..... B63B 22/023 114/256
9,563,203 B2 * 2/2017 Davoodi ..... B63G 8/001
10,961,111 B2 * 3/2021 Meixner ..... B67D 7/3227
2004/0092181 A1 * 5/2004 Porat ..... B63B 22/24 441/136
2004/0108340 A1 * 6/2004 Witt ..... B67D 7/005 222/481.5
2006/0092630 A1 * 5/2006 Kennedy ..... F21S 8/00 362/157
2007/0084868 A1 4/2007 Huber et al.
2014/0332269 A1 * 11/2014 Smith ..... B63B 35/285 175/5
2014/0360891 A1 * 12/2014 Kline ..... F17C 11/005 206/0.7
2015/0159766 A1 * 6/2015 Gammon ..... F16K 24/042 137/197
2015/0204333 A1 * 7/2015 Bryditzki ..... F04B 23/14 417/36

* cited by examiner

CHEMICAL CONTAINER

TECHNICAL FIELD

The present invention relates to a chemical container, and more particularly to a chemical container capable of stably storing and transporting a liquid chemical while smoothly exhausting gas generated from the chemical.

BACKGROUND ART

In general, a liquid chemical is stored or is transported to a place at which the liquid chemical is required in the state of being contained in a container after manufacture thereof.

Representative examples of a chemical container include a glass container and a synthetic resin container. The glass container exhibits excellent chemical resistance and barrier properties; however, the glass container is easily broken due to pressure in the container, collision between containers, or drop of the container. On the other hand, the synthetic resin container has big advantages due to light weight and durability thereof and in an economic aspect of manufacture and distribution thereof. At present, therefore, the synthetic resin container is being used more widely than the glass container.

When a chemical stored in the chemical container leaks, a safety-related accident may occur. Basically, therefore, it is necessary for the chemical container to exhibit airtightness in order to prevent leakage of the chemical and to exhibit durability in order to withstand external impact so as not to be easily broken. In addition, it is necessary for a chemical container configured to store a chemical, from which a large amount of gas is generated in a liquid state, to have a structure capable of preventing overpressure due to generation of gas in a hermetically sealed state.

As an example, oxygenated water used in a sterilizer is naturally decomposed in a state of being stored in a container, whereby gas is generated. Consequently, internal pressure of a container having oxygenated water stored therein increases due to generation of gas from the oxygenated water during storage or transportation. When the internal pressure excessively increases, the chemical may leak through the portion of the container having low airtightness. In a severe case, the container may be broken or may explode. In order to prevent these problems, a container configured to store oxygenated water has a structure capable of exhausting gas.

A conventional chemical container has a structure in which a through-hole configured to discharge gas is formed at an appropriate position of the container in order to prevent overpressure due to generation of gas and the through-hole is covered by a filter membrane. The filter membrane blocks a liquid chemical and transmits only gas, whereby it is possible to prevent an excessive increase in internal pressure of the chemical container. In general, the through-hole and the filter membrane are disposed at the upper surface of the chemical container.

When the conventional chemical container falls sideways, however, the chemical may easily come into contact with the filter membrane. In this case, a gas discharge passage is clogged, whereby gas generated in the chemical container cannot be discharged. As a result, internal pressure of the chemical container may excessively increase, and therefore the above problems may occur.

In order to reduce such problems, a method of disposing through-holes and filter membranes at various positions of the chemical container may be considered. In this case, however, manufacture of the chemical container is troublesome and manufacturing time increases, whereby manufacturing cost increases. In addition, an increase in number of the through-holes to be formed may lead to a decrease in durability of the chemical container.

DISCLOSURE

Technical Problem

The present invention has been made in view of the above problems, and it is an object of the present invention to provide a chemical container capable of discharging gas generated from a chemical by stably securing a discharge passage of the gas even when the posture or tilt of the chemical container is variously changed, i.e. when the chemical container is turned over or falls sideways, whereby it is possible to prevent an excessive increase in internal pressure of the chemical container due to generation of the gas.

The objects of the present invention are not limited to those described above, and other unmentioned objects of the present invention will be clearly understood by a person of ordinary skill in the art from the following description.

Technical Solution

A chemical container according the present invention to accomplish the above object includes a container body having a storage compartment configured to store a chemical, an exhaust port disposed at one side of the container body, the exhaust port being configured to connect the storage compartment and the outside of the container body to each other in such a manner that fluid movement therebetween is possible, an exhaust tube disposed in the storage compartment so as to be connected to the exhaust port in such a manner that fluid movement therebetween is possible, and an exhaust buoyancy unit having a buoyancy body disposed in the storage compartment in the state of being connected to the exhaust tube so as to float on the chemical stored in the storage compartment, an exhaust channel provided inside the buoyancy body, the exhaust channel being configured to connect the storage compartment and the exhaust tube to each other in such a manner that fluid movement therebetween is possible, and a filter membrane coupled to the buoyancy body, the filter membrane being configured to transmit gas through the exhaust channel and to block the chemical, thereby preventing the chemical from passing therethrough.

The distance from the center of gravity of the buoyancy body to the filter membrane may be greater than the distance from the center of the buoyancy body to the filter membrane such that the filter membrane remains located higher than the chemical in the state in which the buoyancy body floats on the chemical.

The exhaust buoyancy unit may include a weight coupled to the buoyancy body, the weight being configured to deviate the center of gravity of the buoyancy body from the center of the buoyancy body.

The weight may be disposed in the buoyancy body.

The exhaust buoyancy unit may include an inlet provided at one side of the buoyancy body so as to be open to the storage compartment, a chamber provided in the buoyancy body so as to be connected to the inlet, and a passage provided at the other side of buoyancy body so as to be connected to the chamber, the passage constituting the exhaust channel together with the inlet and the chamber, and the filter membrane may be disposed so as to cover the inlet.

The buoyancy body may include an upper body having the inlet provided at one side thereof and a lower body having the passage provided at one side thereof, the lower body being coupled to the upper body so as to define the chamber together with the upper body, a tube connection portion, to which the exhaust tube is connected, may be provided at the outer surface of the lower body so as to protrude therefrom, and the passage extends from the lower body to the interior of the tube connection portion.

The exhaust buoyancy unit may include a weight disposed adjacent to the tube connection portion, the weight being configured to deviate the center of gravity of the buoyancy body from the center of the buoyancy body such that the filter membrane remains located higher than the chemical in the state in which the buoyancy body floats on the chemical.

The exhaust buoyancy unit may have a weight coupling portion protruding from the inner surface of the lower body so as to be disposed on an identical straight line to the tube connection portion, the weight may be coupled to the weight coupling portion so as to wrap the circumference of the weight coupling portion, and the passage may extend into the weight coupling portion.

Each of the upper body and the lower body may be made of a synthetic resin material, the upper body and the lower body may be coupled to each other by fusion, and the lower body and the weight may be integrally coupled to each other by insert injection molding.

The chemical container according to the present invention may include a cap made of an elastic material, the cap being coupled to the container body in an assembly manner so as to close a through-hole formed at one side of the container body so as to be open outside, wherein the exhaust portion may be provided at the cap, and the exhaust tube may be coupled to the cap.

Advantageous Effects

A chemical container according to the present invention is configured such that an exhaust buoyancy unit having an exhaust channel is connected to an exhaust port provided at one side of a container body in such a manner that fluid movement therebetween is possible, the exhaust buoyancy unit is disposed in the container body so as to float on a chemical, and a filter membrane configured to transmit only gas is disposed so as to cover the exhaust channel. Even when the posture or tilt of the container body is variously changed, therefore, only gas generated in the container body may pass through the filter membrane of the exhaust buoyancy unit and may then be discharged to the outside through the exhaust channel in the exhaust buoyancy unit and the exhaust port of the container body.

In addition, since the chemical container according to the present invention is capable of discharging gas generated in the container body out of the container body through the exhaust buoyancy unit at any posture thereof, an excessive increase in internal pressure thereof due to generation of gas is prevented. Consequently, a danger of chemical leakage or explosion is very low, and it is possible to safely store and transport various chemicals.

The effects of the present invention are not limited to those mentioned above, and other unmentioned effects will be clearly understood by a person of ordinary skill in the art from the following description.

DESCRIPTION OF REFERENCE NUMERALS

Figure 1:
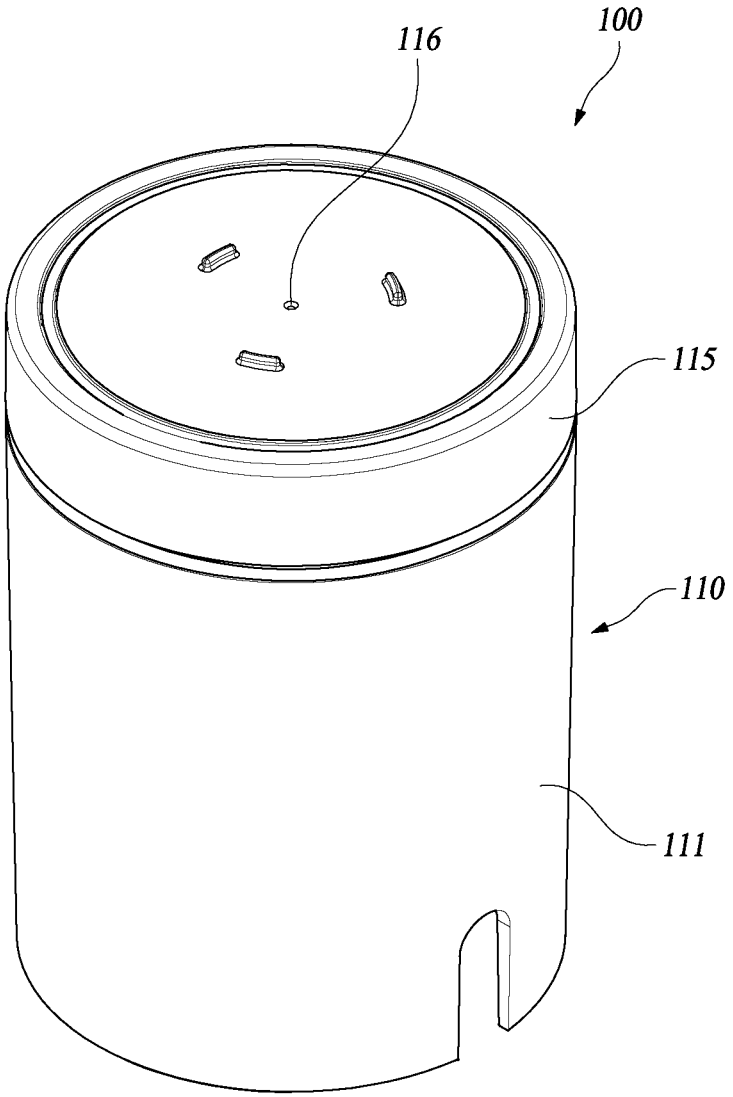
FIGS. 1 and 2 are perspective views showing a chemical container according to an embodiment of the present invention.

100, 200: Chemical containers 110, 210: Container bodies
111: Container body base 112: Opening
113: Chemical supply port 115, 212: Container body lids
116, 216: Exhaust ports 117: Connection pipe
118: Storage compartment 120: Sealing member
124: Opening and closing valve unit 125: Valve unit body
126: Outlet 127: Opening and closing member
128: Spring 130: Exhaust buoyancy unit
131: Buoyancy body 132: Upper body
133: Inlet 134: Seating portion
135: Coupling protrusion 138: Lower body
139: Coupling groove 140: Tube connection portion
141: Catching projection 142: Weight coupling portion
144: Passage 146: Chamber
148: Exhaust channel 150: Filter membrane
152: Weight 154: Exhaust tube
213: Through-hole 215: Cap
217: Insertion groove

BEST MODE

Hereinafter, embodiments of the present invention will be described in detail with reference to the accompanying drawings to such an extent that a person having ordinary skill in the art to which the present invention pertains can easily embody the present invention. The present invention may be realized in various different forms, and is not limited to embodiments described herein.

In order to clearly describe the present disclosure, parts having no relation to the description are omitted. Wherever possible, the same reference numbers will be used throughout the specification to refer to the same or like parts.

Also, in the case in which several embodiments have the same components, the same components will be described using the same reference numerals only when describing a representative embodiment and components different from those of the representative embodiment will be described when describing the other embodiments.

In the case in which one part is said to be "connected" to another part in the entire specification, not only may the one part be "directly connected" to the other part, but also, the one part may be "indirectly connected" to the other part via a further part. In addition, that a certain element is "included" does not mean that other elements are excluded, but means that such elements may be further included unless mentioned otherwise.

Figure 2:
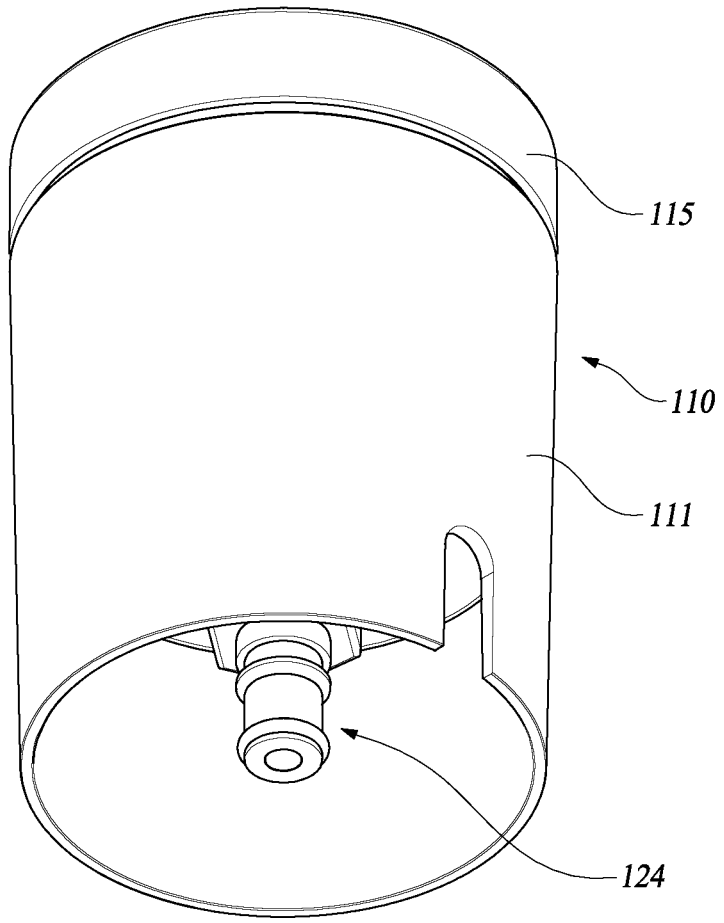
Figure 3:
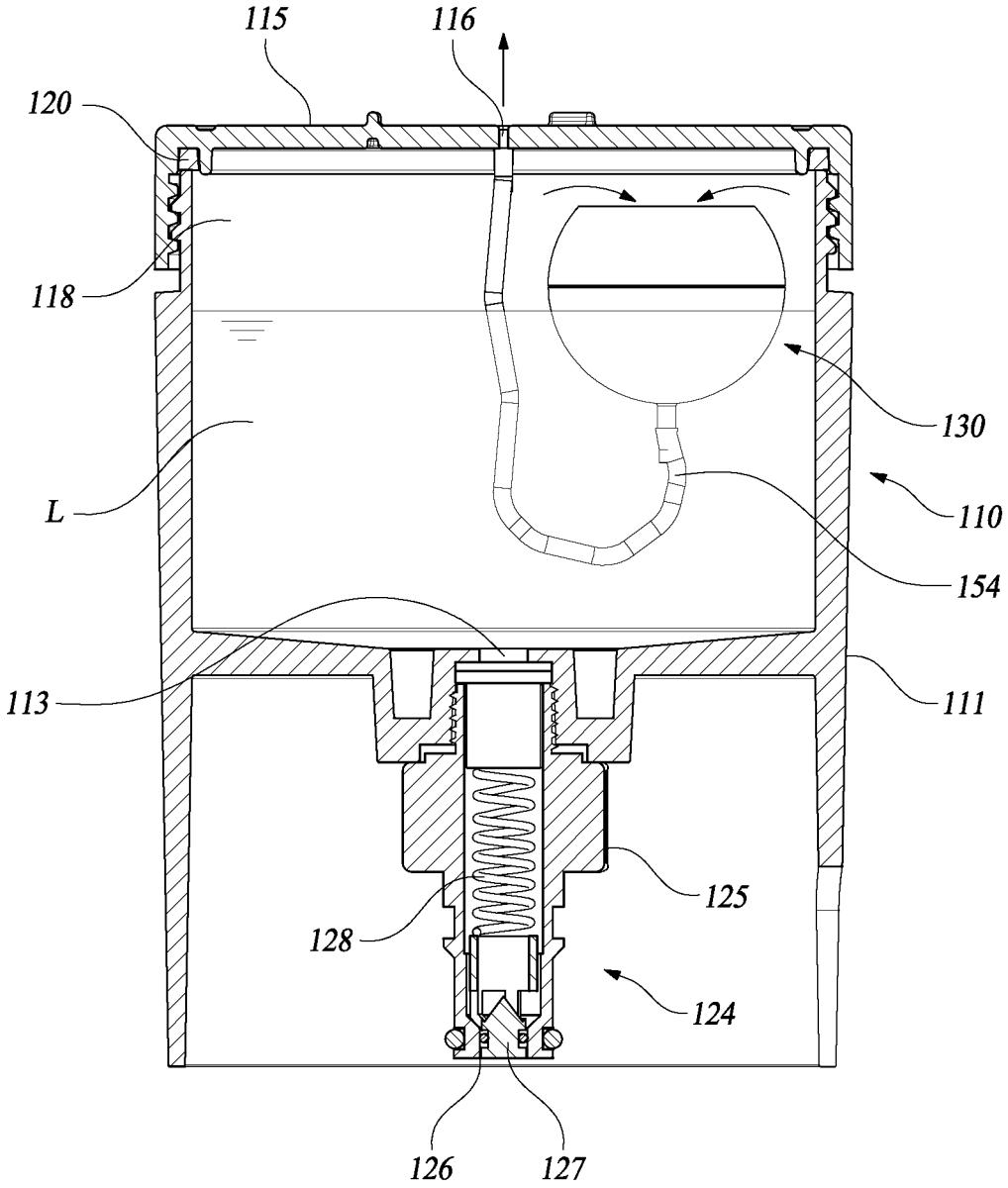
FIG. 3 is a sectional view showing the chemical container according to the embodiment of the present invention.
Figure 4:
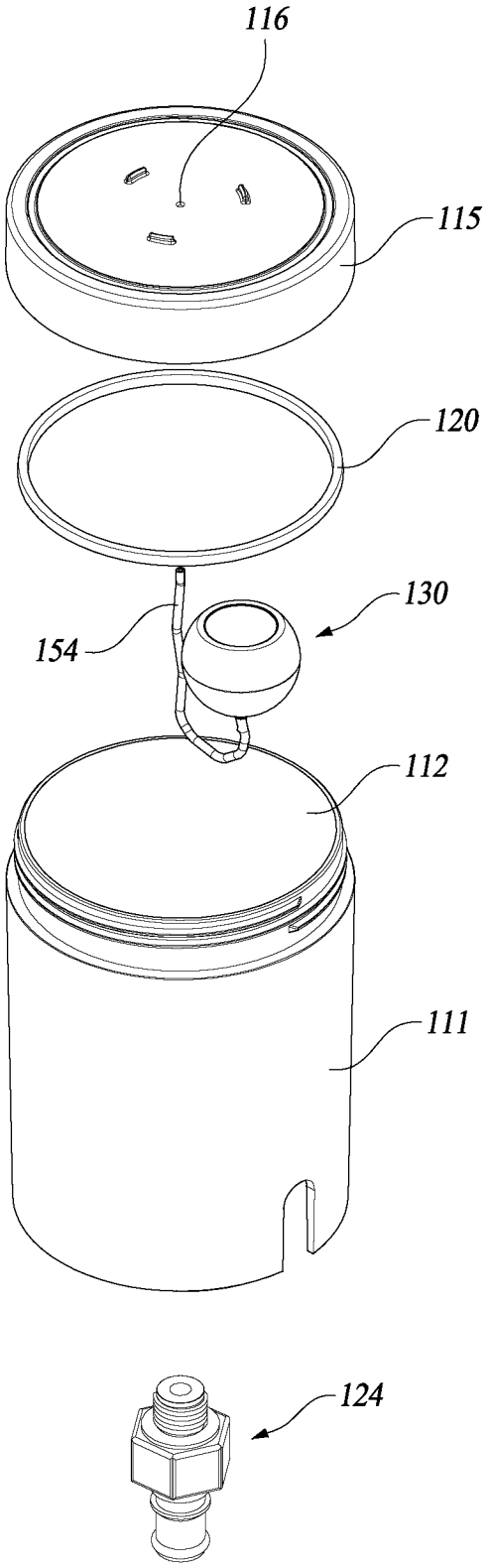
FIGS. 4 and 5 are exploded perspective views showing the chemical container according to the embodiment of the present invention.
Figure 5:
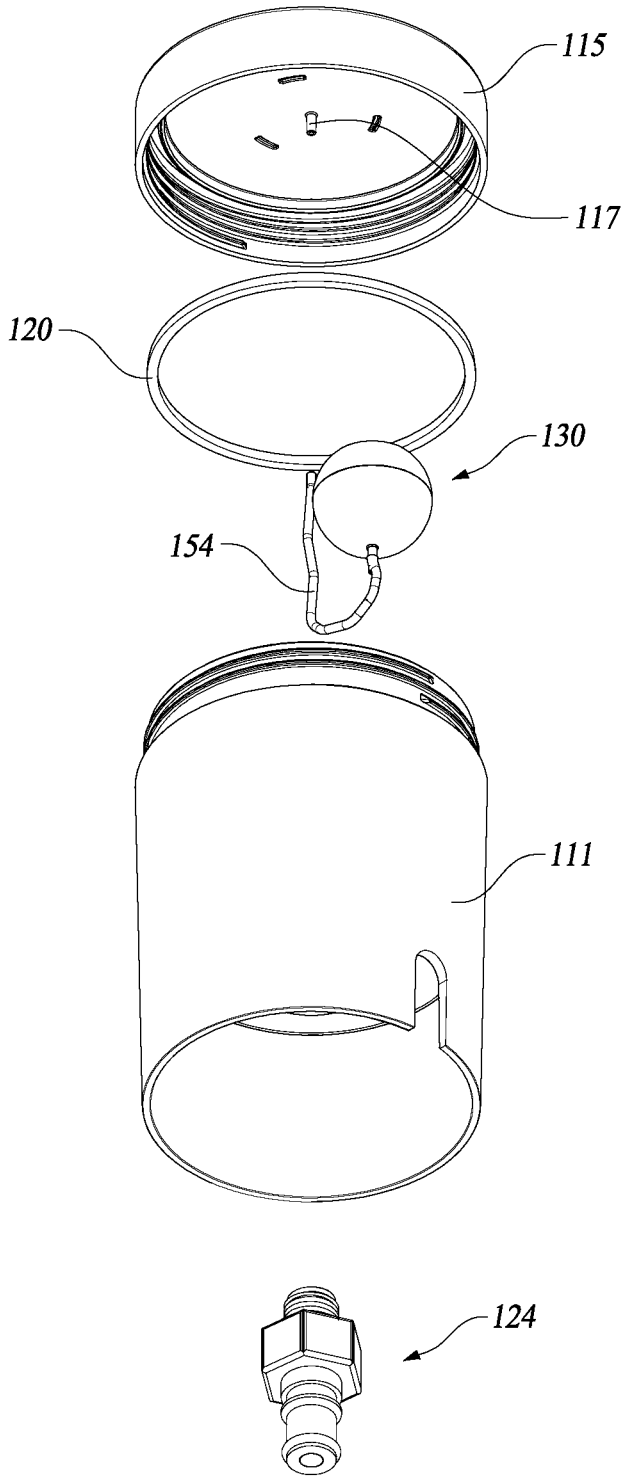
Figure 6:
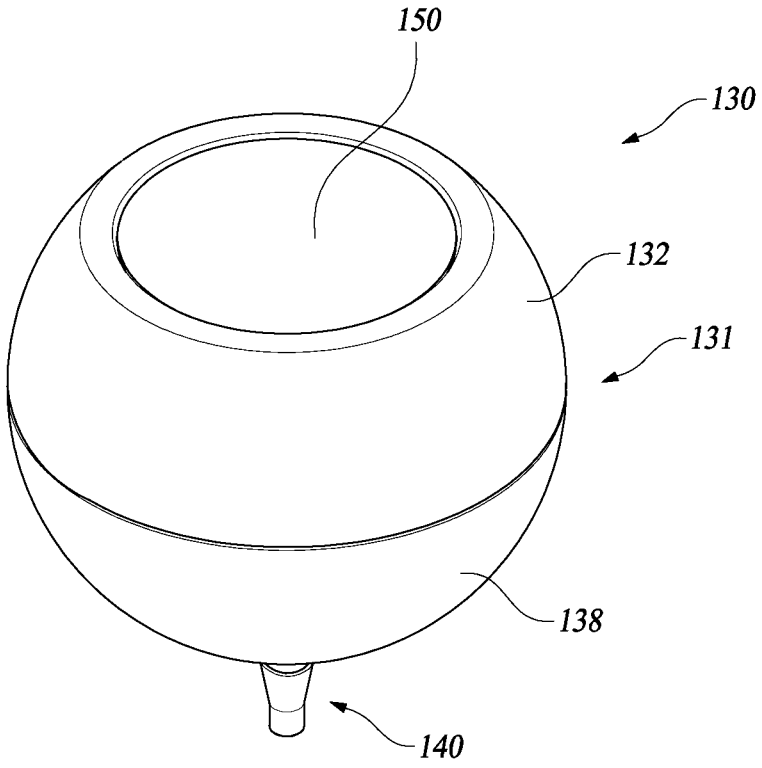
FIG. 6 is a perspective view showing an exhaust buoyancy unit of the chemical container according to the embodiment of the present invention.

FIGS. 1 and 2 are perspective views showing a chemical container according to an embodiment of the present invention, FIG. 3 is a sectional view showing the chemical container according to the embodiment of the present invention, and FIGS. 4 and 5 are exploded perspective views showing the chemical container according to the embodiment of the present invention.

As shown in the figures, the chemical container 100 according to the embodiment of the present invention includes a container body 110 configured to store a liquid chemical L, an opening and closing valve unit 124 coupled to the container body 110 so as to discharge the chemical L stored in the container body 110, and an exhaust buoyancy unit 130 disposed in the container body 110 so as to exhaust gas generated in the container body 110. The chemical container 100 is configured such that the exhaust buoyancy unit 130 floats on the chemical L in the container body 110 so as to exhaust gas, whereby it is possible to stably exhaust gas generated in the container body 110 even when the container body 110 falls.

The container body 110 includes a container body base 111 having an opening 112 provided at one end thereof and a container body lid 115 coupled to the container body base 111 so as to cover the opening 112. The container body base 111 and the container body lid 115 are coupled to each other to define a storage compartment 118 configured to store the chemical L. A chemical supply port 113 is provided at one side of the container body base 111. The chemical L stored in the storage compartment 118 may be discharged from the storage compartment 118 through the chemical supply port 113 so as to be supplied to the outside. An exhaust port 116 configured to exhaust gas from the storage compartment 118 is provided at the center of the container body lid 115.

In the storage compartment 118, the chemical L may be naturally decomposed or evaporated, whereby gas may be generated. The gas generated in the storage compartment 118 may be exhausted out of the container body 110 through the exhaust port 116. A connection pipe 117 is provided inside the container body lid 115. An exhaust tube 154, a description of which will follow, is connected to the connection pipe 117.

A sealing member 120 is interposed between the container body base 111 and the container body lid 115. The sealing member 120 blocks the gap between the container body base 111 and the container body lid 115 to improve airtightness between the container body base 111 and the container body lid 115. As a result, the chemical L stored in the storage compartment 118 is prevented from leaking through the gap between the container body base 111 and the container body lid 115.

The opening and closing valve unit 124 is coupled to the container body 110 to control discharge of the chemical L through the chemical supply port 113. The opening and closing valve unit 124 includes a valve unit body 125 coupled to the container body 110, an outlet 126 provided at the end of the valve unit body 125 so as to communicate with the chemical supply port 113, an opening and closing member 127 movably disposed inside the valve unit body 125 so as to open and close the outlet 126, and a spring 128 configured to elastically support the opening and closing member 127. The opening and closing member 127 may maintain the state in which the outlet 125 is blocked due to elastic force of the spring 128. When the opening and closing member 127 is pushed inwardly of the valve unit body 125, the outlet 126 may be opened, whereby the chemical L stored in the storage compartment 118 may pass through the chemical supply port 113 and may then be discharged to the outside through the outlet 126.

In addition to the shown structure, the opening and closing valve unit 124 may be changed so as to have any of various other structures capable of controlling discharge of the chemical L through the chemical supply port 113.

The exhaust buoyancy unit 130 is disposed inside the container body 110 so as to float on the chemical L, and serves to exhaust gas generated in the storage compartment 118 to the outside. The exhaust buoyancy unit 130 includes a buoyancy body 131, a filter membrane 150, and a weight 152.

The buoyancy body 131 is configured to have a structure capable of floating on the chemical L, and provides a discharge passage configured to allow gas to pass therethrough. The buoyancy body 131 includes an upper body 132 and a lower body 138 coupled to the upper body 132 so as to define a chamber 146 together with the upper body 132.

The upper body 132 is configured to have an approximately hemispherical shape, a portion of which is cut. The end of the upper body 132 is open, and the upper body 132 is provided at one side thereof with an inlet 133 open outside. The inlet 133 may be connected to the chamber 146 so as to allow gas in the storage compartment 118 to be introduced into the chamber 146 therethrough. A seating portion 134 configured to support the filter membrane 150 is provided at the circumference of the inlet 133. A coupling protrusion 135 is provided at the end of the upper body 132. The coupling protrusion 135 is configured to have the shape of a ring that protrudes along the end of the upper body 132.

The lower body 138 is configured to have an approximately hemispherical shape, which corresponds to the shape of the upper body 132. The end of the lower body 138 is open in a shape corresponding to the open end shape of the upper body 132. The lower body 138 is provided at the end thereof with a coupling groove 139, into which the coupling protrusion 135 of the upper body 132 is inserted. The coupling groove 139 is formed along the end of the lower body 138 in a ring shape. Since the coupling protrusion 135 is inserted into the coupling groove 139, it is possible to maintain the gapless secure coupling state between the lower body 138 and the upper body 132. In addition, each of the upper body 132 and the lower body 138 may be made of a synthetic resin material, whereby the upper body and the lower body may be securely coupled to each other by fusion.

A tube connection portion 140 and a weight coupling portion 142 are provided at the lower body 138. The tube connection portion 140 protrudes from the outer surface of the lower body 138. An exhaust tube 154, a description of which will follow, is connected to the tube connection portion 140. A catching projection 141 is provided at one side of the tube connection portion 140. The catching projection 141 prevents the exhaust tube 154 from being easily separated from the tube connection portion 140 after being connected to the tube connection portion 140.

The weight coupling portion 142 protrudes from the inner surface of the lower body 138 so as to be disposed on the same straight line as the tube connection portion 140. A passage 144 is provided in each of the tube connection portion 140 and the weight coupling portion 142. The passage 144 extends from the end of the weight coupling portion 142 to the end of the tube connection portion 140, and may move gas introduced into the chamber 146 to the exhaust tube 154 connected to the tube connection portion 140.

The passage 144 constitutes an exhaust channel 148 of the buoyancy body 131 together with the inlet 133 of the upper body 132 and the chamber 146. The exhaust channel 148 serves to connect the storage compartment 118 and the exhaust tube 154 to each other in such a manner that fluid movement therebetween is possible. Gas introduced into the storage compartment 118 through the inlet 133 may move to the exhaust tube 154 via the chamber 146 and the passage 144 in that order.

The filter membrane 150 is coupled to the buoyancy body 131 so as to cover the exhaust channel 148. Specifically, the filter membrane 150 is seated on the seating portion 134 of the upper body 132 to cover the inlet 133 of the exhaust channel 148. The filter membrane 150 transmits gas and blocks the chemical L. Consequently, only gas generated in the storage compartment 118 may pass through the filter membrane 150 and move to the exhaust tube 154 along the exhaust channel 148, and the chemical L is blocked by the filter membrane 150 and thus may not move to the exhaust channel 148. The filter membrane 150 may be made of any of various materials that transmit gas and do not transmit liquid, such as Gore-Tex.

Figure 7:
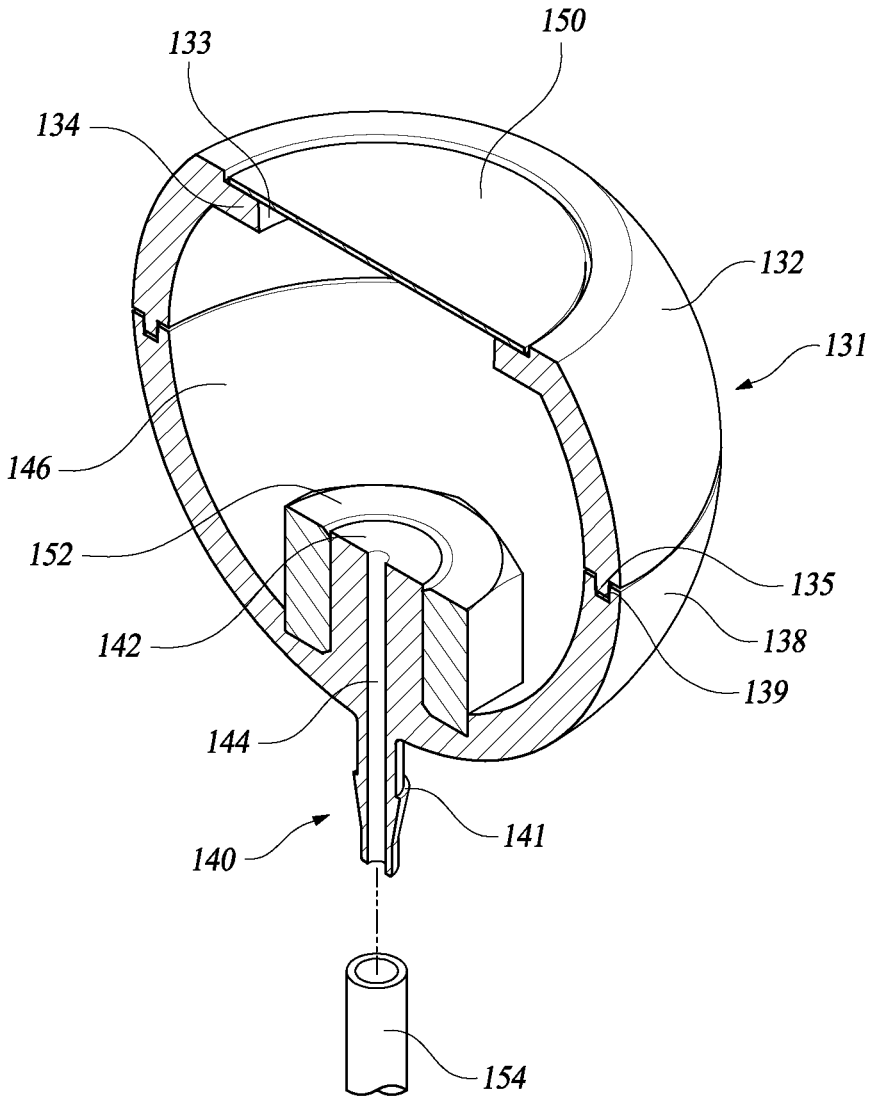
FIG. 7 is a partially cutaway perspective view showing the exhaust buoyancy unit of the chemical container according to the embodiment of the present invention.
Figure 8:
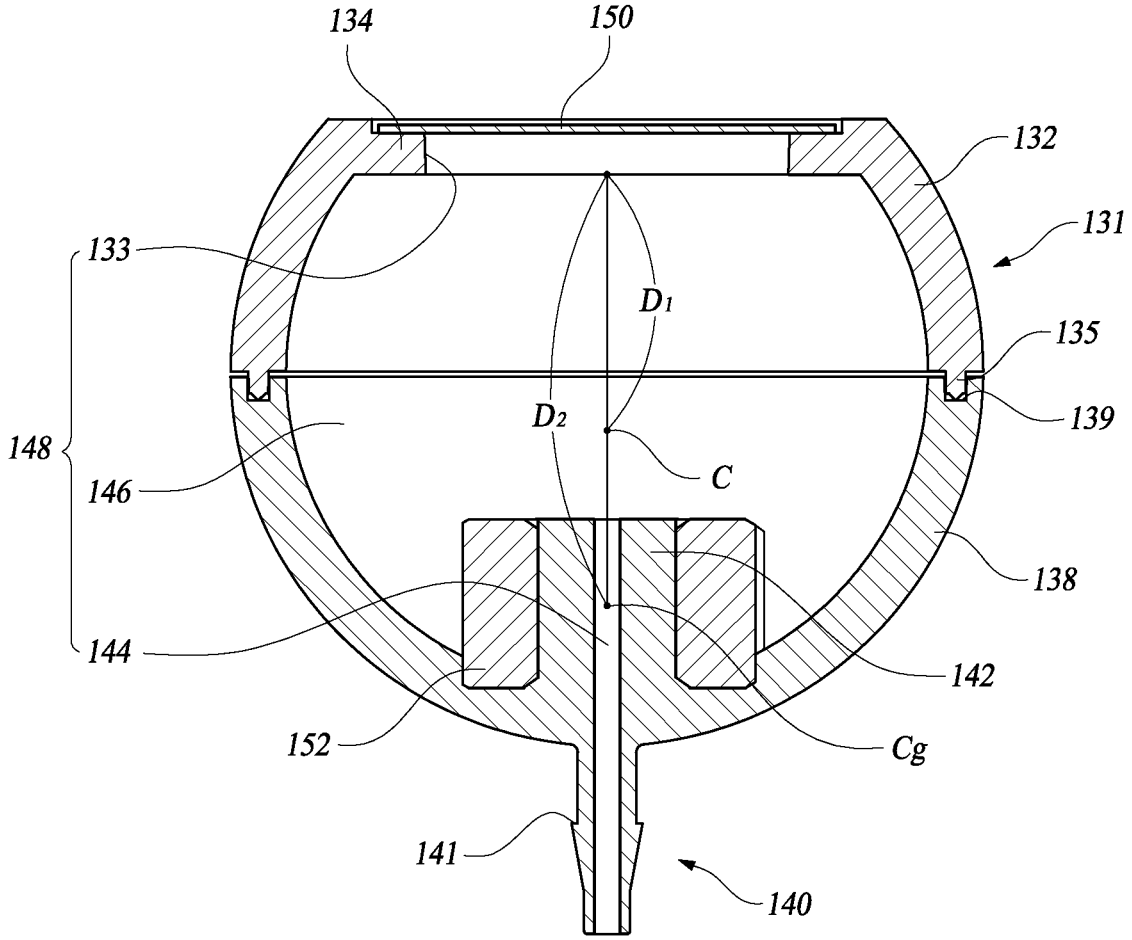
FIG. 8 is a sectional view showing the exhaust buoyancy unit of the chemical container according to the embodiment of the present invention.

The weight 152 is coupled to the buoyancy body 131 in order to deviate the center of gravity Cg of the buoyancy body 131 from the center C of the buoyancy body 131. As shown in FIGS. 7 and 8, the weight 152 is disposed inside the buoyancy body 131 in the state of being coupled to the weight coupling portion 142 so as to wrap the circumference of the weight coupling portion 142 provided on the same straight line as the tube connection portion 140. In the case in which the weight 152 is disposed inside the buoyancy body 131, the weight 152 is prevented from contacting the chemical L, whereby it is possible to prevent damage to the weight 152 due to the chemical L. The lower body 138 and the weight 152 may be integrally coupled to each other by insert injection molding.

The weight 152 is disposed adjacent to the tube connection portion 140 to deviate the center of gravity Cg of the buoyancy body 131 from the center C of the buoyancy body 131. Since the weight 152 deviates the center of gravity Cg of the buoyancy body 131 from the center C of the buoyancy body 131, the distance D2 from the center of gravity Cg of the buoyancy body 131 to the filter membrane 150 is greater than the distance D1 from the center C of the buoyancy body 131 to the filter membrane 150.

As described above, the center of gravity Cg of the buoyancy body 131 is located so as to be spaced apart from the center C of the buoyancy body 131 in a direction away from the filter membrane 150. When the buoyancy body 131 floats on the chemical L, therefore, the filter membrane 150 may be maintained higher than the center of gravity Cg of the buoyancy body 131. Consequently, the filter membrane 150 may be maintained so as to always be located higher than the chemical L in the state in which the buoyancy body 131 floats on the chemical L.

Figure 9:
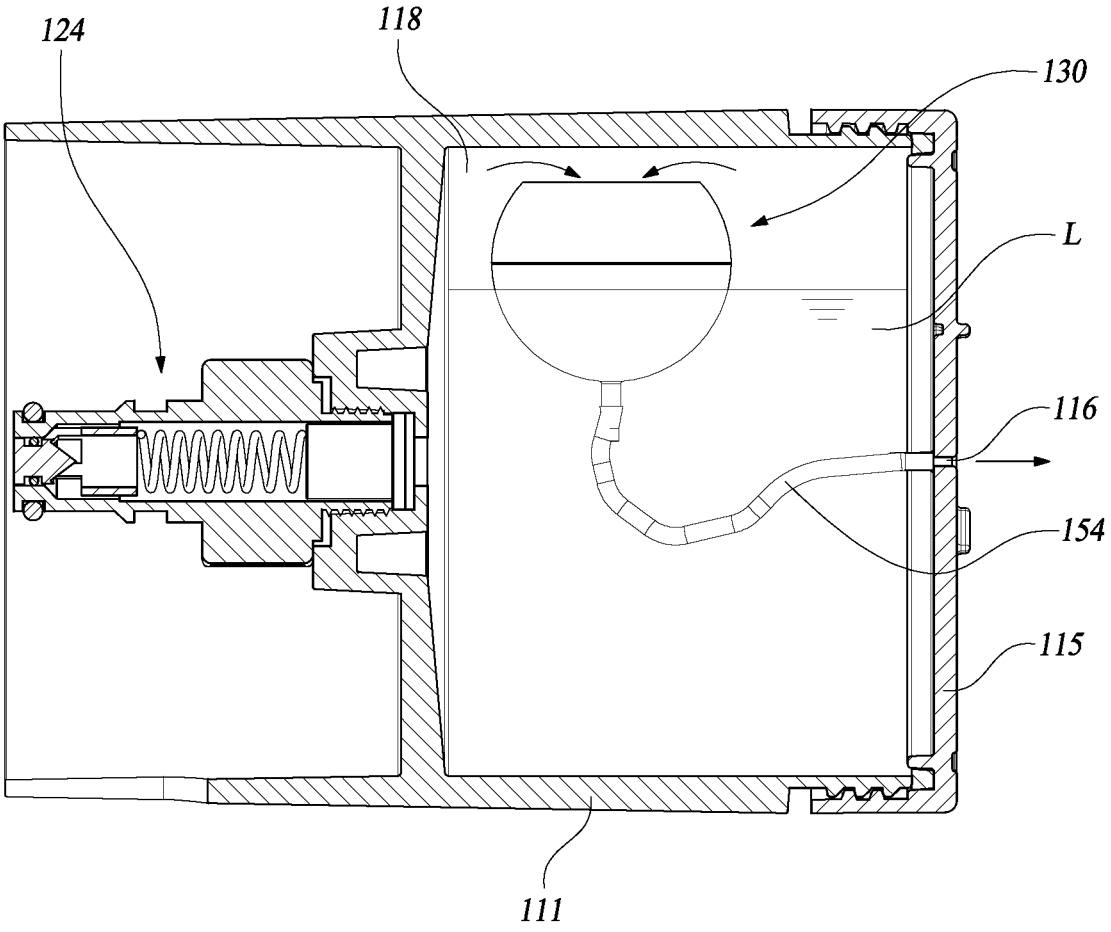
FIG. 9 shows the state in which the chemical container according to the embodiment of the present invention is laid sideways.

For example, as shown in FIG. 3, the buoyancy body 131 may float on the chemical L such that the filter membrane 150 is located above the chemical L so as to face upwards in the state in which the container body 110 stands such that the exhaust port 116 faces upwards. In addition, even when the container body 110 falls sideways, as shown in FIG. 9, the buoyancy body 131 may float on the chemical L such that the filter membrane 150 is located above the chemical L so as to face upwards. Consequently, the filter membrane 150 may always be located higher than the chemical L irrespective of the posture or tilt of the container body 110, and gas generated from the chemical L may pass through the filter membrane 150 and may then be discharged to the outside through the exhaust channel 148 of the buoyancy body 131.

The exhaust buoyancy unit 130 is connected to the container body 110 through the exhaust tube 154. One end of the exhaust tube 154 is connected to the connection pipe 117 of the container body lid 115, and the other end of the exhaust tube 154 is connected to the tube connection portion 140 of the buoyancy body 131, whereby the exhaust buoyancy unit 130 is connected to the exhaust port 116 of the container body 110 in such a manner that fluid movement therebetween is possible. Consequently, gas introduced into the buoyancy body 131 may move to the exhaust port 116 along the exhaust tube 154 and may then be discharged out of the container body 110 through the exhaust port 116. The exhaust tube 154 is made of a soft material capable of being bent in various shapes such that the exhaust buoyancy unit 130 can move in the storage compartment 118.

In the chemical container 100 according to the embodiment of the present invention, as described above, the exhaust buoyancy unit 130 having the exhaust channel 148 is connected to the exhaust port 116 provided at one side of the container body 110 in such a manner that fluid movement therebetween is possible and is disposed in the container body 110 so as to float on the chemical L, and the filter membrane 150 configured to transmit only gas is disposed so as to cover the exhaust channel 148. Even in the case in which the posture or tilt of the container body 110 is variously changed, therefore, gas generated in the container body 110 may pass through the filter membrane 150 of the exhaust buoyancy unit 130, may move along the exhaust channel 148 in the exhaust buoyancy unit 130, and may be discharged to the outside through the exhaust port 116.

In addition, since the chemical container 100 according to the embodiment of the present invention is capable of discharging gas generated in the container body 110 out of the container body 110 through the exhaust buoyancy unit 130 at any posture thereof, an excessive increase in internal pressure thereof due to gas generation is prevented. Consequently, it is possible to safely store and transport the chemical L.

Figure 10:
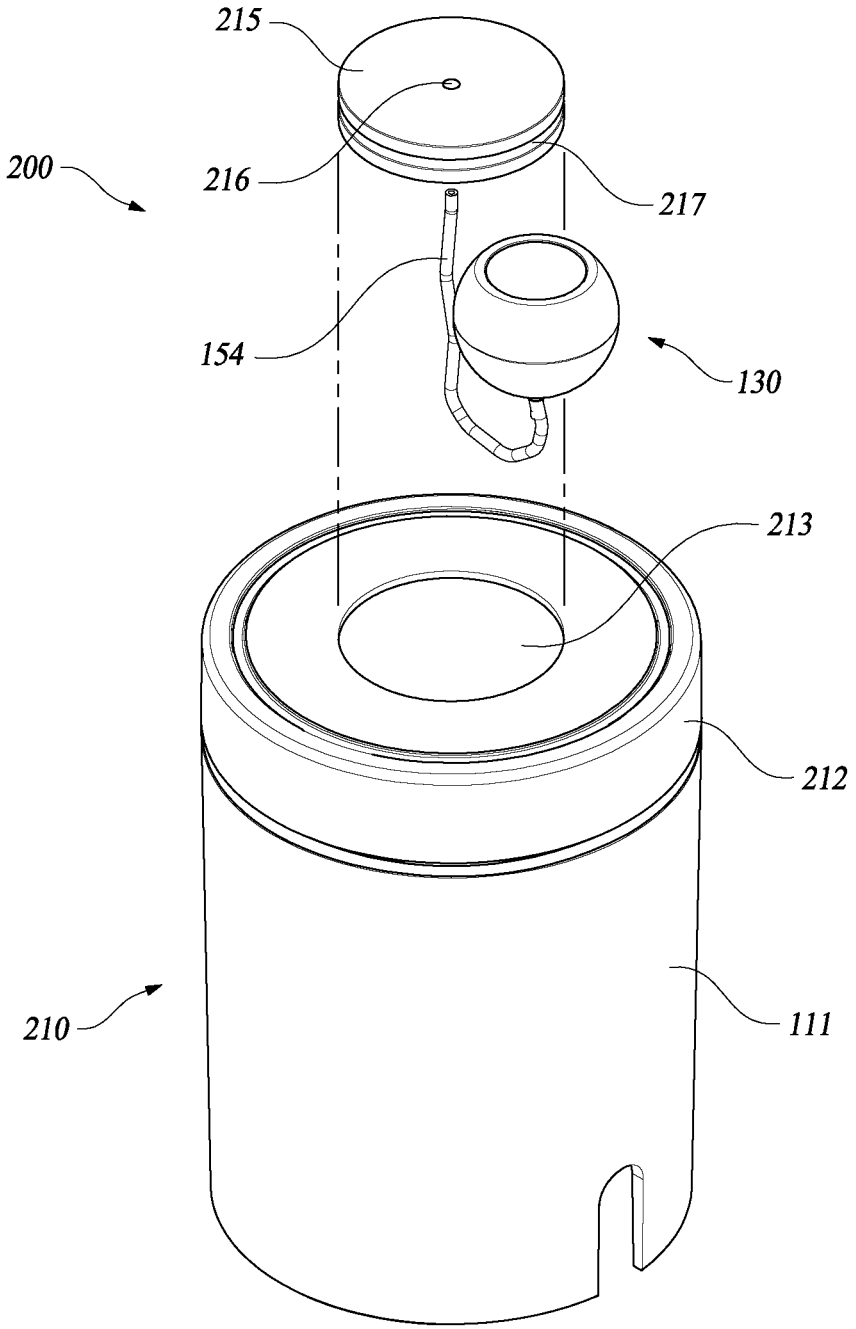
FIG. 10 is an exploded perspective view showing a chemical container according to another embodiment of the present invention.

FIG. 10 is an exploded perspective view showing a chemical container according to another embodiment of the present invention.

The chemical container 200 shown in FIG. 10 includes a container body 210 configured to store a liquid chemical L, an opening and closing valve unit 124 (see FIG. 3) coupled to the container body 210 so as to discharge the chemical L stored in the container body 210, an exhaust buoyancy unit 130 disposed in the container body 210 so as to exhaust gas generated in the container body 210, and a cap 215 coupled to the container body 210 and connected to the exhaust buoyancy unit 130. Here, some components, such as the opening and closing valve unit 124 and the exhaust buoyancy unit 130, are identical to those described above.

The container body 210 includes a container body base 111 and a container body lid 212 coupled to the container body base 111 so as to define a storage compartment 118 configured to store the chemical L together with the container body base 111. The container body base 111 is identical to that described above. A through-hole 213 is provided at the center of the container body lid 212.

The cap 215 may be coupled to the container body lid 212 in an assembly manner so as to close the through-hole 213. The cap 215 is made of an elastic material, such as rubber. An exhaust port 216 configured to allow gas generated in the container body 210 to be exhausted therethrough is provided at the center of the cap 215, and an insertion groove 217 is provided at the edge of the cap 215. When the cap 215 is inserted into the through-hole 213, the circumferential portion of the through-hole 213 of the container body lid 212 is inserted into the insertion groove 217 of the cap 215, whereby the cap 215 may be securely coupled to the container body lid 212 without any gap therebetween.

One end of an exhaust tube 154 connected to the exhaust buoyancy unit 130 is connected to the cap 215. The exhaust tube 154 is connected to the exhaust port 216 of the cap 215 in such a manner that fluid movement therebetween is possible. Consequently, gas generated in the container body 210 may be introduced into the exhaust buoyancy unit 130 and may then be discharged to the outside through the exhaust tube 154 and the exhaust port 216.

In the chemical container 200 described above, the exhaust buoyancy unit 130 configured to exhaust gas generated in the container body 210 may be connected to the cap 215 and may be coupled to the container body 210 via the cap 215 in an assembly manner. Consequently, an assembly of the cap 215 and the exhaust buoyancy unit 130 may be manufactured as a single product so as to be coupled to container bodies having various sizes and various shapes for use thereof, which is advantageous in manufacture and supply.

Although preferred embodiments of the present invention have been described above, the scope of the present invention is not limited to the configurations described and shown above.

For example, the drawings show that the container body 110 or 210 having the storage compartment 118 provided therein includes the container body base 111 and the container body lid 115 or 212 separably coupled to the container body base 111; however, the container body may be changed so as to have any of various structures capable of storing the chemical L.

In addition, the drawings show that the exhaust port 116 or 216 configured to exhaust gas generated in the container body 110 or 210 is disposed at the upper surface of the container body lid 115 or 212; however, the position of the exhaust port 116 or 216 may be variously changed.

In addition, the drawings show that the buoyancy body 131 of the exhaust buoyancy unit 130 includes the hemispherical lower body 138 and the upper body 132 coupled to the lower body 138; however, the shape of the buoyancy body 131 may be variously changed. In addition, the exhaust channel 148 provided in the buoyancy body 131 may be changed so as to have any of various other structures in addition to the structure including the inlet 133, the chamber 146, and the passage 144, as shown.

In addition, the drawings show that the weight 152 is disposed inside the buoyancy body 131 so as to be adjacent to the tube connection portion 140; however, the weight 152 may be installed at any of various other positions. In the case in which the weight is made of a material that does not react with the chemical L, the weight may be coupled to the outside of the buoyancy body 131.

Also, in the case in which the structure of the buoyancy body is appropriately changed such that the center of gravity of the buoyancy body is located spaced apart from the center of the buoyancy body in a direction away from the filter membrane 150, the weight 152, which is separate from the buoyancy body, may be omitted.

Also, in the above description, the upper body 132 and the lower body 138, each of which is made of a synthetic resin material, are coupled to each other by fusion; however, the upper body 132 and the lower body 13 may be made of various materials other than the synthetic resin and may be coupled to each other using various coupling methods other than fusion.

Furthermore, the lower body 138 and the weight may be coupled to each other using various methods other than insert injection molding.

Although the present invention has been shown and described above in connection with the preferred embodiments for illustrating the principle of the present invention above, the present invention is not limited to the constructions and operations shown and described above. Rather, those skilled in the art to which the present invention pertains will well understand that various modifications and variations can be made without departing from the idea and scope of the appended claims.

The invention claimed is:

1. A chemical container comprising:

a container body having a storage compartment configured to store a chemical;

an exhaust port disposed at one side of the container body, the exhaust port being configured to connect the storage compartment and an outside of the container body to each other such that fluid movement therebetween is possible;

an exhaust tube disposed in the storage compartment so as to be connected to the exhaust port such that fluid movement therebetween is possible; and an exhaust buoyancy unit having a buoyancy body disposed in the storage compartment being connected to the exhaust tube so as to float on the chemical stored in the storage compartment, an exhaust channel provided inside the buoyancy body, the exhaust channel being configured to connect the storage compartment and the exhaust tube to each other such that fluid movement therebetween is possible, and a filter membrane coupled to the buoyancy body, the filter membrane being configured to transmit gas through the exhaust channel and to block the chemical, thereby preventing the chemical from passing therethrough, wherein the exhaust buoyancy unit comprises an inlet provided at one side of the buoyancy body so as to be open to the storage compartment, a chamber provided in the buoyancy body so as to be connected to the inlet, and a passage provided at another side of buoyancy body so as to be connected to the chamber, the passage constituting the exhaust channel together with the inlet and the chamber, the filter membrane is disposed so as to cover the inlet, the buoyancy body comprises an upper body having the inlet provided at one side thereof and a lower body having the passage provided at one side thereof, the lower body being coupled to the upper body so as to define the chamber together with the upper body, a tube connection portion, to which the exhaust tube is connected, is provided at an outer surface of the lower body so as to protrude therefrom, the passage extends from the lower body to an interior of the tube connection portion, and the exhaust buoyancy unit comprises a weight disposed adjacent to the tube connection portion, the weight being configured to deviate a center of gravity of the buoyancy body from a center of the buoyancy body such that the filter membrane remains located higher than the chemical with the buoyancy body floating on the chemical.

2. The chemical container according to claim 1, wherein the exhaust buoyancy unit has a weight coupling portion protruding from an inner surface of the lower body so as to be disposed on an identical straight line to the tube connection portion, the weight is coupled to the weight coupling portion so as to wrap a circumference of the weight coupling portion, and the passage extends into the weight coupling portion.

3. The chemical container according to claim 1, wherein each of the upper body and the lower body is made of a synthetic resin material, the upper body and the lower body being coupled to each other by fusion, and the lower body and the weight are integrally coupled to each other by insert injection molding.

4. The chemical container according to claim 1, comprising:

a cap made of an elastic material, the cap being coupled to the container body in an assembly manner so as to close a through-hole formed at one side of the container body so as to be open outside, wherein the exhaust portion is provided at the cap, and the exhaust tube is coupled to the cap.

* * * * *